US005114495A

United States Patent [19]

Mainz

[11] Patent Number: 5,114,495

[45] Date of Patent: May 19, 1992

[54] USE OF AZEOTROPIC COMPOSITIONS IN VAPOR DEGREASING

[75] Inventor: Eric L. Mainz, Colwich, Kans.

[73] Assignee: Vulcan Materials Company, Wichita, Kans.

[21] Appl. No.: 650,201

[22] Filed: Feb. 4, 1991

[51] Int. Cl.[5] ..... B08B 5/00; B08B 3/05

[52] U.S. Cl. ..... 134/11; 134/31; 134/40; 252/DIG. 9

[58] Field of Search ..... 134/11, 31, 40; 252/DIG. 9

[56] References Cited

U.S. PATENT DOCUMENTS

| | | | |
|---|---|---|---|
| 2,310,569 | 5/1942 | Booth | 252/DIG. 9 |
| 3,021,235 | 2/1962 | Schumacher . | |
| 3,733,218 | 5/1973 | Begun | 134/31 |
| 3,794,524 | 2/1974 | Nogueira et al. | 134/31 |
| 4,289,542 | 9/1981 | Roehl | 134/11 |
| 4,367,098 | 1/1983 | McCord . | |
| 4,650,493 | 3/1987 | Pahlsson et al. . | |
| 4,753,735 | 6/1988 | Figiel | 134/11 |

FOREIGN PATENT DOCUMENTS

| | | | |
|---|---|---|---|
| 1296837 | 4/1969 | United Kingdom | 134/3 |

OTHER PUBLICATIONS

Chemical Abstracts 95(4):26498e, Minina et al.

Manual on Vapor Degreasing, Third Edition, ASTM Manual Series: MLN 2, Revision of Special Technical Publications (STP) 310 A, Jun. 1989.

*Primary Examiner*—Theodore Morris

*Assistant Examiner*—Zeinab El-Arini

*Attorney, Agent, or Firm*—Burns, Doane, Swecker & Mathis

[57] ABSTRACT

A vapor cleaning process for cleaning soil from solid articles comprising the use of an azeotropic vapor mixture of perchloroethylene and water as the cleaning agent which condenses on the articles and thus cleans them. Liquid perchloroethylene and water are placed in a lower portion of a degreasing chamber, the articles to be cleaned are introduced into an upper portion of the chamber, the perchloroethylene and water are heated and evaporated to form a minimum-boiling azeotropic vapor mixture, the vapor mixture is condensed on the articles whereby soil is removed from them, and the cleaned articles are then removed from the chamber.

7 Claims, 1 Drawing Sheet

USE OF AZEOTROPIC COMPOSITIONS IN VAPOR DEGREASING

BACKGROUND OF THE INVENTION (a) Field of the Invention

This invention relates to an improved process for vapor degreasing using a chlorinated $C_2$ hydrocarbon, or more particularly a mixture of perchloroethylene and water, as a solvent.

Vapor degreasing is a highly effective process for physically removing solvent soluble soils and other entrapped soils from metal, glass, plastic, coated items and other essentially non-porous articles that are not affected by the solvent. In vapor degreasing the selected liquid solvent is evaporated from a reservoir, the vapors are condensed on the soiled articles whereby the condensate washes off the soil and then returns to the reservoir for reuse.

(b) Description of the Prior Art

Solvents heretofore used in vapor degreasing include 1,1,2-trichloro-1,2,2-trifluoroethane (CFC-113), methylene chloride, 1,1,1-trichloroethane, perchloroethylene and trichloroethylene, among others. Many blends such as for example, CFC-113 plus methylene chloride or 1,1,1-trichloroethane plus propanol are also used in the metal and electronics cleaning industries.

Solvents are chosen for specific applications based on the physical properties of the individual solvent or blends of solvents. Important properties include boiling point which dictates the temperature to which a part being cleaned will be heated, toxicity which limits acceptable worker exposure rates, and flammability which limits the range of solvent blends which can be safely used. Evolving regulations of solvent emissions due to contributions to ozone depletion and/or greenhouse effect are increasingly affecting the choice cf solvent and methods used in metal and electronics cleaning.

Solvent properties such as boiling point, flammability, solvent power and even solvent toxicity can be adjusted by mixing several solvents together. However, the use of simple blends can be unacceptable in vapor degreasing due to fractionation of the blends to an undesirable degree. The fractionation of the solvent blend during distillation can make the solvent mixture nearly impossible to recover for reuse at the original composition.

A partial solution to the fractionation problem has been to use certain azeotropic mixtures of organic solvents having constant composition characteristics and constant boiling points. The vapor degreasing and vapor defluxing systems act as a distillation still. Unless the solvent is a pure material having a constant boiling point, or is an azeotrope or azeotrope-like mixture, fractionation will occur and undesirable solvent distribution will occur which can affect the efficacy and safety of the cleaning operation.

Azeotropes are either maximum- or minimum-boiling in nature, having a boiling point above or below that of any of the components in the mixture. Minimum-boiling azeotropes can be beneficial in metal and electronic cleaning operations, as the lower boiling point results in a cooler part temperature, rendering parts handling much safer to operating personnel.

As is well known, azeotropes can be formed with combinations of polar and nonpolar solvents. Use of a mixture of 1,1,1,-trichloroethane and n-propanol is a common example of such an azeotropic system. This formulation has been found useful in the commercial cleaning of electronic components and ionic contaminants from metal or other surfaces. However, 1,1,1,-trichloroethane becomes relatively easily decomposed in the presence of water, giving rise to acidic, corrosive components in the system, and consequently the field of use for this solvent system has had its limitations.

Vapor degreasing is of course broadly old. A general description of the process, its various: modifications, its applications, and the equipment used can be found, for instance, in Manual on Vapor Degreasing, Third Edition, ASTM Manual Series: MLN 2, Revision of Special Technical Publications (STP) 310 A, June 1989, the full text of which is hereby incorporated by reference in this patent specification.

As described in this ASTM Manual in FIG. 1*b*, in its simplest form a solvent vapor degreasing machine is a tank with a heat source, e.g., a steam coil, to boil the solvent in a boiling sump or reservoir located in a bottom portion of the tank and a cool annular surface at an intermediate or upper section of the periphery of the tank, which causes the solvent vapors to condense on the wall and run down and defines a solvent vapor level in the tank above which the solvent vapors do not diffuse to any substantial extent, with an air space above that level. The annular cool surface can be formed, for instance, by means of a water jacket located at a suitable height around the tank and/or condensing coils located inside the tank. At the same time, as the soiled parts or articles are at approximately ambient temperature when they are introduced into the degreasing tank and suspended in the air-free zone of solvent vapor, the hot vapors condense onto the cool parts, dissolving greases and other soluble contaminants and providing a continuous rinse in clean solvent. As the condensed solvent drains from the parts, it carries off the soils and returns them to the boiling sump proper or to an adjacent condensate reservoir. In the operation of the present invention, all the condensed perc and water which thus return to the liquid reservoir from above as a result of condensation of the azeotropic vapor mixture on the parts being cleaned or on the internal cooling coils or on the cooled tank wall will normally overflow from the reservoir to the sump for further evaporation once the reservoir becomes filled with the high-density perc. However, a water layer of adjustable depth can be maintained on top of the perc in the condensate reservoir by suitable modification of the equipment and its operation. More particularly, the depth of such water layer consequently covering the condensed perc layer in the reservoir can be readily adjusted as may be desired, taking advantage of the much greater density of perc versus water.

For instance, as illustrated in FIG. 2 of the drawing, a perc transfer line 40 which is fitted with a height-adjustable overflow line 42 can be added connecting the reservoir to the sump. Increasing the height of the overflow will raise the level of perc in the reservoir. At a sufficiently high level all perc and water will overflow a weir placed at the upper edge of the reservoir and no perc will flow to the sump through the transfer line, which will result in a minimal level of water remaining to cover the perc in the reservoir. By lowering the overflow line the perc layer height in the codensate reservoir will drop with a substantial water layer forming above the perc up to the weir overflow. During operation at such a setting, all subsequent condensed perc will flow through the perc transfer line back to the boiling sump while the condensed water phase will overflow the weir of the reservoir back to the boiling sump. Adjusting the overflow line height will also result in a higher or lower depth of water being maintained in the boiling sump.

Vapor treatment in degreasing is often augmented by mechanical action, for instance, by immersion of the soiled parts in a section of the tank containing liquid perc solvent before the parts are raised into the vapor zone for vapor degreasing, or by additionally spraying the parts with liquid perc or water while they are in the vapor degreasing zone. Ultrasonic agitation of the solvent may also be employed while the soiled parts are immersed therein.

The parts are usually held in the vapor zone for rinsing by the condensing vapors until the parts reach vapor temperature, at which time condensation stops. The parts dry quickly within the machine as they are withdrawn from the vapor into the air space. A hood may be provided above the tank further to minimize diffusion of solvent vapors into the atmosphere.

In a conveyorized cross rod degreaser, such as that described in FIG. 5 on page 12 of the previously mentioned ASTM Manual on Vapor Degreasing, baskets containing the work can be automatically transferred from a roller conveyor, without the necessity of transferring the parts before and after the cleaning process. Large parts can be handled or a monorail from which the parts are suspended. If the monorail is suitably contoured as shown in FIG. 2 on page 4 of the ASTM Manual, the suspended parts can thus pass in a continuous sequence from the outside through the vapor degreasing zone, where cleaning may be augmented by use of a liquid solvent spray, and or out of the chamber.

SUMMARY AND OBJECTS OF THE INVENTION

Accordingly, it is among the objects of this invention to provide a vapor degreasing process and apparatus that operates at a relatively low temperature.

It is another object to provide a vapor degreasing process using a solvent that does not readily decompose in the course of the degreasing operation.

It is still another object to provide a vapor degreasing process using as the cleaning composition a constant boiling mixture of water and a relatively stable chlorinated hydrocarbon, which mixture is capable of removing from soiled articles in a single step both hydrophobic soils such as oils and greases and hydrophilic soils such as metal salts.

More particularly, according to the present invention an azeotrope of perchloroethylene ("perc") and water is used in a conventional vapor degreaser or vapor defluxer for the cleaning of metal, glass, electronic components or other nonporous media. This azeotrope composition consists of approximately 17 weight percent water and approximately 83 weight percent perohloroethylene and, as stated in the literature, has a boiling point of about 88° C. at 760 mm Hg (standard atmospheric pressure). This is a minimum-boiling azeotrope, since perc and water have respective boiling points of 121° and 100° C. The mixture is nonflammable and can serve as a direct, drop-in replacement in conventional vapor degreasers used for cleaning metal parts or the analogous "vapor defluxers" used for removing flux from electronic components and circuit boards. A cleaning system using this liquid mixture is particularly useful as a substitute for cleaning processes based on CFC-113 and 1,1,1,-trichloroethane, which face increasing regulation.

Figure 1:
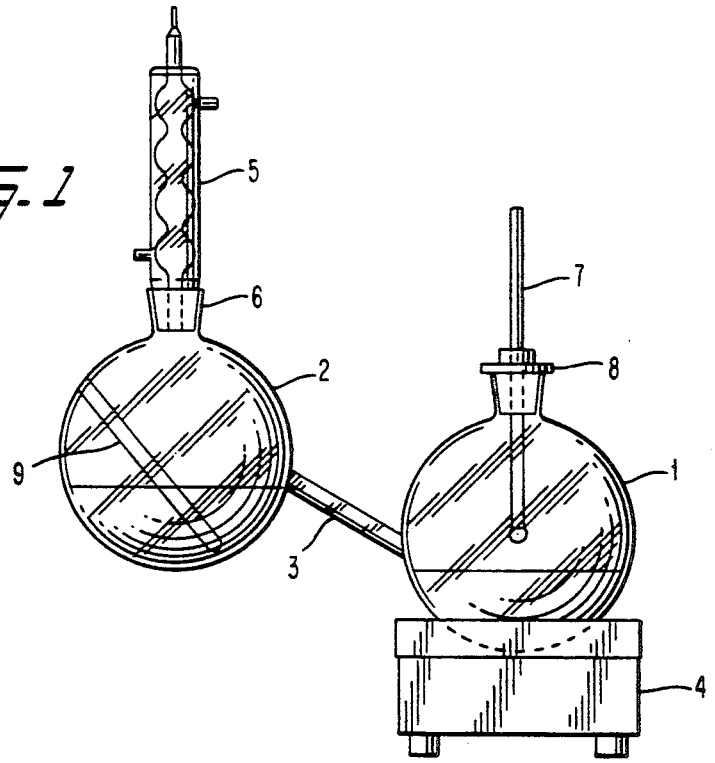
FIG. 1 is a schematic illustration of a bench-scale degreaser comprising two interconnected chambers, the lower chamber being equipped with an electric heater capable of heating the liquid contents of the chamber to the boiling point and the more elevated chamber being equipped with a reflux condenser which causes the vapor mixture to condense and the condensed liquid to overflow from the condensate sump back to the heated chamber for reuse. The parts to be cleaned are suspended in the vapor space of the lower chamber.

Optionally, although not shown, such a degreaser may contain an ultrasonic vibrator in the condensate reservoir for cleaning the soiled parts while they are immersed in the liquid phase therein and/or spray nozzles for spraying the soiled parts with liquid solvent while they are suspended in the vapor zone. Depending on the type of soil to be removed, either water or perc can be pumped from the nozzles for spraying the parts.

DETAILED DESCRIPTION OF THE INVENTION

The cleaning process of the invention comprises the use of a mixture of perchloroethylene ($C_2C_{14}$, boiling point=121.0° C.) and water ($H_2O$, boiling point=100° C.) in a vapor degreasing or vapor defluxing apparatus. Perc and water are essentially immiscible liquids, having only minimal solubility in each other. However, a low-boiling azeotrope does form on heating and is described in Azeotropic Data-III, Advances in Chemistry Series 116, as having a composition of 15.8 to 17.2 weight percent water and 84.2 to 82.8 weight percent perc, with a boiling point of about 88° C., and more specifically 87.7° to 88.5° C. In commercial practice, where ambient pressure may vary between about 700 and 770 mm Hg, the azeotropic boiling point will fall in the range between about 85° and about 90° C.

As described in the previously mentioned ASTM Manual on Vapor Degreasing, the vapor degreasing process generally comprises a heated chamber comprising at the bottom a liquid reservoir or boiling sump to vaporize the liquid solvent, i.e., stratified or mechanically mixed water and perc, and a cooled surface at an upper level of the chamber to condense the solvent vapors and keep them from escaping from the chamber. In such a process the parts to be cleaned, which are at room temperature, are introduced into the degreaser and directly suspended in the vapor space of the chamber, causing the azeotropic vapor mixture to condenses on the parts. Thus, the parts are continuously rinsed by substantially pure water and liquid perc, until the cleaned parts are withdrawn and allowed to dry.

The cooled, condensed solvent which now contains the soil removed from the parts flows back to the boiling sump or to an adjacent condensate reservoir which may be used for immersion cleaning prior to or after a vapor degreasing step. If desired, the reservoir may be fitted with an ultrasonic agitator to improve solvent agitation. As a further variation, the condensate reservoir may also be connected to a solvent pump which can recirculate the solvent in the reservoir or be connected to a spray apparatus for causing simultaneous spray cleaning and vapor degreasing of the parts while they are suspended in the vapor zone of the degreaser. In more elaborate cleaning cycles, the work to be cleaned can first be dipped in moderately warm condensate liquid in the condensate reservoir (e.g., at 35° to 45° C.) before being suspended in the vapor space; or one can use a combination of dipping in boiling liquid in the sump followed by dipping in warm liquid in the condensate reservoir and then vapor degreasing; or one can use still other combinations, permutations or sequences of steps, as is otherwise well known in the art.

As already stated, the process of the instant invention uses as the degreasing solvent a mixture of perc and water which upon heating produces a vapor mixture corresponding to a constant boiling, azeotropic composition of water and perc. This composition is above the saturation point of water in perc or perc in water. As perc and water are mutually insoluble or virtually insoluble, the presence of a small amount of water, e.g. 2 parts of water or less per 100 parts perc, is sufficient to produce an azeotrope vapor cloud in the degreaser upon heating. Of course, a greater proportion of water may be used. In any event, the amount of water present in the system must be at least sufficient to produce a volume of azeotropic vapor mixture that is capable of filling the volume of the vapor degreasing zone in the degreaser. The required minimum of water is readily determined empirically from case to case.

Typically, the mixture in the heated solvent chamber or boiling sump will be comprised of two distinct liquids, with perc having a density substantially greater than 1.0 (1.631 at 15° C.) being at least initially the bottom layer and water being the top layer. Depending on the amount of liquids in the boiling sump and the location and height of the heating coils or heating surface used to heat the liquids in the sump, either the perc, or the water, or both layers can be heated to reach the boiling point of the azeotrope. During ebullition, the two liquids may become more or less homogeneously mixed.

In conventional vapor degreasers water is often cited as being detrimental to the cleaning process. This is due to the chemical incompatibility of relatively unstable solvents such as 1,1,1,-trichloroethane and water, which can lead to decomposition of the solvent to acidic components and corrosion not only of parts being cleaned but also of the degreaser equipment. For this reason, many conventional degreasers are traditionally equipped with water separators to remove accidentally introduced water from the solvent after the solvent vapors are condensed but before the solvent is returned to the condensate reservoir.

By contrast, the process of the invention, using perc as the organic solvent, deliberately introduces a substantial amount of water into the system. It does not require the use of a water separator, although such a separation can be used to adjust the amount of water in the degreaser if large amounts of water are being drawn into the process from the atmosphere or if liquid water, such as from a water-based cooling or milling fluid, is being transferred into the degreaser with the parts which are being cleaned.

Perc undergoes decomposition by hydrolysis only very slowly and has for this and other reasons long been recognized as an excellent solvent for cleaning greases, oils and other soils from metal and other nonporous parts by using liquid-phase degreasing. When used as a commercial solvent, its chemical stability is commonly improved by the addition of a small amount, on the order of about 0.2 to 1 percent, of any of a number of chemical stabilizers or stabilizer combinations comprising, for instance, one or more amines, alcohols, epoxides, dioxane, and so on, as is otherwise well known in the art. See, for instance "Chlorine, Its Manufacture, Properties and Uses", Edited by J. S. Sconce, Reinhold Publishing Corporation, New York (1962), pages 390–392.

However, because of its relatively high boiling point 121° C., has been considered relatively unattractive for use in vapor degreasing processes as compared with the less stable but lower-boiling halogenated solvents such as trichlorotrifluoroethane (CFC-113), trichloroethylene, methylene chloride, or 1,1,1-trichloroethane. The high temperature inherent in the use of perc alone in vapor degreasing can be detrimental to parts which are temperature sensitive and can render the cleaned parts too hot for easy handling on removal from the vapor cleaning process.

On the other hand, because perc is relatively highly resistant to hydrolysis and forms a minimum-boiling azeotrope with water, its azeotropic mixture with water has been found to be a uniquely suitable solvent in vapor degreasing. Because of the low boiling point of the perc-water azeotrope (about the same as the boiling point of pure trichloroethylene and only eight degrees higher than the boiling point of 1,1,1-trichloroethane), parts cleaned in accordance with the present invention are easily handled after only a short drying time or cool-down time on removal from the cleaning process.

Another advantage of the invention is the deliberate inclusion of both water and perc in the vapor. This enables the easy, simultaneous dissolution and removal of both hydrophobic contaminants such as oils or greases and polar contaminants such as inorganic salts, activators in activated rosin fluxes and other ionic contaminants.

Still another advantage of the invention is the very low loss rate of the relatively high boiling perc solvent by diffusion from the vapor degreaser/defluxer not only while the degreasing process is in operation but also during shutdown periods. The degreaser can easily be designed or retrofitted with a level control device which will insure that a water layer remains at all times in place on top of the perc layer in both the boiling sump and condensate reservoir during shutdown periods. With conventional vapor degreasing processes using halogenated solvents such as CFC-113, 1,1,1,-trichloroethane or even essentially water-free perc, diffusion loss rates are substantial during non-operational periods.

EXAMPLE 1

A mixture composed of 600 ml of commercial solvent-grade perchloroethylene ("Per Sec" perchloroethylene sold by Vulcan Chemicals) and 200 ml of deionized water are charged to the lower chamber or flask of a two-chamber Pyrex glass degreaser schematically shown in FIG. 1. This degreaser consists of two 1000 ml, round-bottom flasks 1 and 2 connected at the midpoint of each flask with an 18 mm Pyrex glass overflow tube 3. The overflow tube separates the flasks by 160 mm, with the upper flask 2 positioned about 90 mm above the lower flask 1. A heating mantle 4 (Precision Scientific, Inc., 550 Watt/120-volt with 3.175 cm upper refractory hole) is placed beneath the lower flask 1.

An Allihn condenser 5 is inserted into the 24/40 joint of the upper flask 2. A thermometer 7 is placed in the 24/40 joint 8 of the lower flask 1. This lower, heated flask functions as the boiling sump, while the upper flask functions as the condensate reservoir of a two-chamber degreaser.

Heat is applied to the lower chamber 1 at a rate producing a rolling boil of the perc and water mixture. The temperature of the condensing vapor in the sump chamber is recorded at 87.2° C., indicating azeotropic composition. Vapor condensing in the Allihn condenser is separating into a perc fraction having a low surface tension and a water fraction having a high surface tension which causes water droplets to collect on the internals of the condenser 5. The condensed liquids continuously drip back down onto the surface of the liquid perc condensate that accumulates in the condensate reservoir 2, whence both the water condensate and the perc condensate overflow down to the boiling sump 1.

Carbon steel coupons 19 mm wide, 76 mm long and 0.25 mm thick (not shown) are cut from a stock of Precision Brand Products Steel Shim, Part No. 16A-10. Ridgid Brand dark thread cutting oil 70830 is poured into a 22.9 cm Pyrex glass baking dish (not shown) to a depth of about 6 mm. A steel coupon is placed in the dish and fully submerged in the cutting oil and soaked for one minute. The coupon is removed and drained for about 30 seconds at room temperature while a copper wire is attached to the coupon by wrapping around one end (not shown). The thermometer is removed from the boiling sump chamber and the drained, cool coupon and wire holder are passed through the joint. The joint is sealed with a flexible Teflon polytetrafluoroethylene plug, and heating of the perc—water cleaning mixture is continued.

The steel coupon is rapidly cleaned by the azeotropic vapors of perc and water which condense on the cool surface of the coupon and rinse it off. After one minute of vapor degreasing, the coupon appears clean and bright. The warm, treated coupon is removed from the degreaser, appears oil-free and quickly becomes cool enough to touch.

EXAMPLE 2

Figure 2:
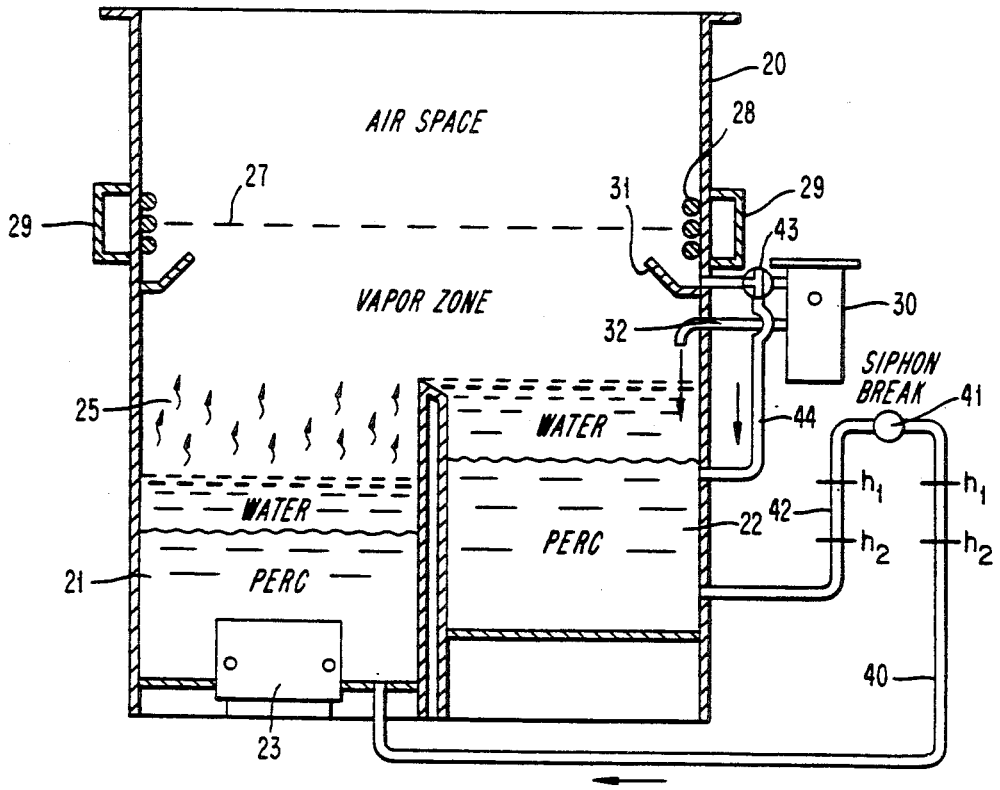
FIG. 2 is a schematic illustration of a commercial type liquid-liquid-vapor degreasing tank comprising a boiling sump for vaporizing the cleaning liquids, a vapor zone thereabove with cooling coils inside and a water jacket around the outside of the tank that defines an upper level below which the solvent vapors are substantially contained, and a condensate reservoir adjacent the boiling sump, allowing the liquid condensate to drip or flow back down into the reservoir and eventually into the boiling sump.

About 26.1 liters of commercial perchloroethylene (vapor-degreasing grade sold by Vulcan Chemicals) and 7.95 liters of distilled, deionized water is charged to a Branson Model B-400R Vapor Degreaser 20, which is a small commercial degreaser designed for cleaning small metal and electronics parts. As schematically illustrated in FIG. 2 of the drawing, this kind of degreaser essentially contains a boiling sump chamber 21, a refrigerated vapor condenser 28, 29 around its perimeter, and an overflowing condensate reservoir 22. After charging the solvent mixture into the sump 21, the unit is started according to its operating instructions. Within a short time after electric heater 23 is turned on, a condensing vapor blanket at a temperature of about 86° C. (at a barometric pressure of about 725 mm Hg) is formed below the vapor level 27 circumscribed by the peripheral vapor condenser which comprises refrigerated condensing coils 28 and a water jacket 29. A water separator 30, equipped with a condensate trough 31 and an overflow pipe 32 may be used to control the water content of the system, but is not otherwise required.

Several carbon steel coupons about 150 mm wide, 150 mm long and 0.25 mm thick are cut from a roll of Precision Brand Products Steel Shim, Part No. 16A-10. A 1.5 mm hole is punched in one corner of each of these coupons through which a copper wire is attached. Ridgid Brand dark thread cutting oil 70830 is poured into a 22.9 cm Pyrex glass baking dish (not shown) to a depth of about 6 mm. One of the steel coupons is placed in the dish fully submerged in the cutting oil soaked for one minute, removed and drained for about 30 seconds at room temperature. This steel coupon is then suspended in the vapor zone 25 of the degreaser 20. Perc and water vapor rapidly condense on the cool surface of the coupon, washing the oil coating away. After five minutes the coupon is removed and found to have a bright surface, free of the thread cutting oil. Had the coupon surface been also contaminated with a water-soluble salt, for instance, sodium chloride, calcium chloride, potassium nitrate or the like, such an inorganic contaminant would have been removed from the coupon by the condensing water simultaneously as the oil was removed by the condensing perc.

In reading this specification and attached claims, it should be understood that all proportions and percentages of materials are stated on a weight basis throughout unless some other basis is indicated explicitly or implicitly. It should also be understood that while the foregoing description of the invention includes preferred embodiments and specific examples, many variations and modifications of what has been described may be employed by those skilled in the art without departing from the scope or spirit of this invention and are to be considered within the scope of the appended claims.

I claim:

1. A process for removing both hydrophobic and water-soluble soil from the surface of solid articles by vapor phase degreasing in a degreasing zone having a boiling sump in a lower portion thereof containing a lower liquid layer consisting essentially of perchloroethylene and an upper liquid layer consisting essentially of water and a vapor space thereabove, which process comprises introducing the soiled solid articles into the vapor space of the degreasing zone at a temperature below the boiling of the perchloroethylene-water vapor mixture formed therein, heating said liquid perchloroethylene and water in the sump to a boil thereby forming an azeotropic vapor mixture consisting essentially of perchloroethylene and water which condenses in the vapor space on the soiled articles located therein thereby cleaning them, and returning the resulting liquid condensate containing the removed soil to the boiling sump for further evaporation..

2. A process for cleaning soil from the surface of solid articles by treatment with a cleaning mixture consisting essentially of perchloroethylene and water, which process comprises:

providing a liquid perchloroethylene phase and a separate liquid water phase thereabove in a lower portion of a cleaning zone, heating the water and perchloroethylene to a boil, thereby partially evaporating the liquids and forming an azeotropic vapor mixture consisting essentially of from about 82 to 85 weight percent perchloroethylene and correspondingly about 18 to 15 weight percent water in a vapor space above the liquids in the cleaning zone, introducing articles soiled with both perchloroethylene-soluble and water-soluble contaminants at a temperature below the boiling point of the azeotropic vapor mixture into said vapor space of the cleaning zone, contacting said articles with the azeotropic vapor mixture until both the perchloroethylene-soluble and the water-soluble contaminants are removed from the articles while at least partially condensing the vapor mixture on the articles, returning the resulting condensed liquids and removed contaminants to the lower portion of the cleaning zone, and removing the cleaned articles from the cleaning zone.

3. A vapor cleaning process according to claim 2, wherein the azeotropic vapor cleaning composition consists essentially of about 82.8 to 84.2 weight percent perchloroethylene and correspondingly about 17.2 to 15.8 weight percent water and has a boiling point of between 85° and 90° C. depending on ambient pressure.

4. A vapor cleaning process according to claim 2, wherein the cleaning zone comprises a coolable perimeter zone with a condensate trough region therebelow at a level between the liquid sump portion and the top of the cleaning zone, which process comprises:

cooling said perimeter zone to a temperature lower than the boiling point of the evaporated azeotropic mixture thereby condensing said azeotropic mixture in said perimeter zone, collecting the condensed mixture in said trough region, returning the resulting clean liquid condensate to a condensate overflow reservoir zone adjacent to said liquid sump portion, and dipping said articles in said clean condensate in the overflow reservoir zone, thereby cleaning soil from the articles by contact with clean liquid condensate in addition to their being cleaned by contact with the azetropic vapor mixture.

5. A vapor cleaning process according to claim 4, which comprises the steps of agitating the liquid condensate in a lower portion of the cleaning zone by ultrasonic agitation, immersing the soiled articles in said agitated liquid before degreasing them in the vapor space of the cleaning zone, and ultimately removing them from the cleaning zone.

6. A vapor cleaning process according to claim 4, wherein the articles to be cleaned are exposed in the vapor space of the cleaning zone both to the azeotropic vapor mixture and to spraying with perchloroethylene condensate pumped up from a lower portion of the condensate reservoir zone.

7. A vapor cleaning process according to claim 4, wherein the articles to be cleaned are exposed in the vapor space of the cleaning zone both to the azeotropic vapor mixture and to spraying with water condensate pumped up from the condensate reservoir zone.

* * * * *